US011896184B2

(12) United States Patent
Innes et al.

(10) Patent No.: US 11,896,184 B2
(45) Date of Patent: Feb. 13, 2024

(54) VACUUM CLEANING DEVICE WITH FOLDABLE WAND TO PROVIDE STORAGE CONFIGURATION

(71) Applicant: SHARKNINJA OPERATING LLC, Needham, MA (US)

(72) Inventors: Daniel John Innes, West Roxbury, MA (US); Jason Thorne, Wellesley Hills, MA (US); Andre David Brown, Natick, MA (US); Gary Palladino, Sommerville, MA (US); Catriona C. A. Sutter, Brookline, MA (US); Lee Cottrell, Newton, MA (US); Scott Niedzwecki, East Walpole, MA (US); Junghwan Chei, Chestnut Hill, MA (US)

(73) Assignee: SharkNinja Operating LLC, Needham, MA (US)

( * ) Notice: Subject to any disclaimer, the term of this patent is extended or adjusted under 35 U.S.C. 154(b) by 196 days.

(21) Appl. No.: 17/222,075

(22) Filed: Apr. 5, 2021

(65) Prior Publication Data

US 2021/0219798 A1 Jul. 22, 2021

Related U.S. Application Data

(63) Continuation of application No. 15/333,109, filed on Oct. 24, 2016, now Pat. No. 10,966,581.

(Continued)

(51) Int. Cl.

*A47L 9/24* (2006.01)
*A47L 5/24* (2006.01)

(Continued)

(52) U.S. Cl.

CPC ..... *A47L 5/24* (2013.01); *A47L 5/28* (2013.01); *A47L 9/0009* (2013.01); *A47L 9/24* (2013.01); *A47L 9/242* (2013.01)

(58) Field of Classification Search

CPC ..... A47L 9/248; A47L 9/242; A47L 9/244

See application file for complete search history.

(56) References Cited

U.S. PATENT DOCUMENTS 1,759,947 A 5/1930 Lee
2,074,042 A 3/1937 Bank (Continued)

FOREIGN PATENT DOCUMENTS

CA 1258277 8/1989
CA 2399848 A1 9/2003

(Continued)

OTHER PUBLICATIONS

PCT Search Report and Written Opinion dated Jan. 8, 2018, received in related Application No. PCT/US17/57227, 9 pgs.

(Continued)

*Primary Examiner* — Bryan R Muller

(74) *Attorney, Agent, or Firm* — Grossman Tucker Perreault & Pfleger, PLLC

(57) ABSTRACT

Vacuum cleaning devices include foldable wands to provide a storage configuration and/or facilitate use. A vacuum cleaning device includes a wand having a first end coupled to a vacuum unit and a second end coupled to a vacuum head or surface cleaning head. The wand defines an air passage allowing air to pass from the surface cleaning head to the vacuum unit and includes a flexible air passage along at least a portion of the wand. The wand also includes a plurality of segments pivotably connected together such that the wand is foldable about 180° in a forward direction until the vacuum (Continued)

unit is positioned proximate a top of the surface cleaning head, thereby providing a storage configuration.

20 Claims, 12 Drawing Sheets

Related U.S. Application Data

(60) Provisional application No. 62/245,206, filed on Oct. 22, 2015.

(51) Int. Cl.
*A47L 5/28* (2006.01)
*A47L 9/00* (2006.01)

(56) References Cited

U.S. PATENT DOCUMENTS

| | | | | |
|---|---|---|---|---|
| 3,163,707 | A | 12/1964 | Darling | |
| 3,245,698 | A | 4/1966 | Fromknecht | |
| 3,306,634 | A | 2/1967 | Groves | |
| 3,314,039 | A | 4/1967 | Opper | |
| 3,451,495 | A | 6/1969 | Bayless et al. | |
| 4,158,462 | A | 6/1979 | Coral | |
| 4,393,536 | A | 7/1983 | Tapp | |
| 4,644,605 | A | 2/1987 | Joss et al. | |
| 4,928,792 | A * | 5/1990 | Krause | E06C 1/32 182/163 |
| 5,107,567 | A | 4/1992 | Ferrari et al. | |
| 5,331,715 | A | 7/1994 | Johnson et al. | |
| 5,927,758 | A | 7/1999 | Carlsson | |
| 5,996,175 | A | 12/1999 | Fusco | |
| 6,015,298 | A | 1/2000 | Linhart | |
| 6,155,620 | A | 12/2000 | Armstrong | |
| 6,345,408 | B1 | 2/2002 | Nagai et al. | |
| 6,553,613 | B2 | 4/2003 | Onishi et al. | |
| 6,695,352 | B2 * | 2/2004 | Park | A47L 9/242 285/317 |
| 6,739,787 | B1 | 5/2004 | Bystrom | |
| 6,779,229 | B2 | 8/2004 | Lee et al. | |
| 6,904,640 | B2 | 6/2005 | Jin et al. | |
| 7,194,784 | B2 | 3/2007 | Overvaag et al. | |
| 7,226,302 | B2 | 6/2007 | Walter et al. | |
| 7,281,298 | B2 | 10/2007 | Joung et al. | |
| 7,383,609 | B2 | 6/2008 | Ji | |
| 7,496,984 | B2 | 3/2009 | Pang | |
| 7,507,269 | B2 | 3/2009 | Murphy et al. | |
| 7,516,762 | B2 | 4/2009 | Colbachini | |
| 7,681,279 | B2 | 3/2010 | Kelly | |
| 8,020,251 | B2 | 9/2011 | Luebbering et al. | |
| 8,296,901 | B2 | 10/2012 | Rosenzweig et al. | |
| 8,813,297 | B2 | 8/2014 | Rosenzweig et al. | |
| 8,918,952 | B2 | 12/2014 | Rowntree | |
| 8,966,711 | B2 | 3/2015 | Millington et al. | |
| 8,984,701 | B2 | 3/2015 | Tussy | |
| 9,125,538 | B2 | 9/2015 | Paliobeis | |
| 9,215,960 | B2 | 12/2015 | Conrad | |
| 9,480,378 | B2 | 11/2016 | Paliobeis | |
| D810,369 | S | 2/2018 | Woo et al. | |
| D836,865 | S | 12/2018 | Niedzwecki et al. | |
| D892,420 | S | 8/2020 | Niedzwecki et al. | |
| 10,966,581 | B2 | 4/2021 | Innes et al. | |
| 2002/0101075 | A1 | 8/2002 | Park et al. | |
| 2004/0134022 | A1 | 7/2004 | Murphy et al. | |
| 2004/0211029 | A1 * | 10/2004 | Ueda | A47L 9/242 15/414 |
| 2004/0261212 | A1 | 12/2004 | Park et al. | |
| 2004/0261213 | A1 | 12/2004 | Park et al. | |
| 2005/0022338 | A1 | 2/2005 | Muhlenkamp | |
| 2005/0081326 | A1 | 4/2005 | Jeon | |
| 2005/0115018 | A1 | 6/2005 | Jeon | |
| 2006/0137128 | A1 | 6/2006 | Elsworthy et al. | |
| 2006/0156510 | A1 | 7/2006 | Park et al. | |
| 2008/0174105 | A1 | 7/2008 | Hyatt | |
| 2008/0295282 | A1 * | 12/2008 | Olsson | A47L 9/242 15/415.1 |
| 2009/0019663 | A1 * | 1/2009 | Rowntree | A47L 5/24 15/347 |
| 2010/0117357 | A1 | 5/2010 | Hyatt | |
| 2010/0229315 | A1 | 9/2010 | Rosenzweig | |
| 2012/0216361 | A1 | 8/2012 | Millington et al. | |
| 2014/0237755 | A1 * | 8/2014 | Conrad | A47L 5/225 15/329 |
| 2015/0096143 | A1 | 4/2015 | Conrad | |
| 2017/0079495 | A1 | 3/2017 | Blanchard et al. | |
| 2017/0290484 | A1 | 10/2017 | Emmett et al. | |
| 2019/0059672 | A1 | 2/2019 | Zhang | |
| 2019/0357740 | A1 | 11/2019 | Thorne et al. | |

FOREIGN PATENT DOCUMENTS

| | | | |
|---|---|---|---|
| CN | 1958259 | | 5/2007 |
| CN | 210169955 | | 3/2020 |
| CN | 210300851 | | 4/2020 |
| DE | 19843973 | A1 | 7/1999 |
| DE | 102007036524 | A1 | 2/2009 |
| DE | 102012112532 | A1 | 6/2014 |
| EP | 1310202 | A1 | 5/2003 |
| EP | 1543757 | | 6/2005 |
| EP | 1764021 | A1 | 3/2007 |
| EP | 2082675 | | 6/2010 |
| EP | 1981387 | B1 | 10/2011 |
| EP | 2680734 | B1 | 11/2016 |
| EP | 3566628 | | 7/2022 |
| GB | 2386054 | A | 9/2003 |
| GB | 2488368 | A | 8/2012 |
| GB | 2499120 | A | 8/2013 |
| GB | 2499120 | B | 2/2014 |
| JP | 3424151 | B2 | 8/1998 |
| JP | 2000300484 | | 10/2000 |
| JP | 2005161009 | A | 6/2005 |
| JP | 2012179356 | A | 9/2012 |
| JP | 2013070839 | A | 4/2013 |
| JP | 2013192867 | A | 9/2013 |
| JP | 2013192869 | A | 9/2013 |
| JP | 2013192880 | A | 9/2013 |
| JP | 2013198701 | A | 10/2013 |
| JP | 2014045870 | A | 3/2014 |
| JP | 5602168 | B2 | 10/2014 |
| JP | 2016036426 | A | 3/2016 |
| JP | 2016112076 | | 6/2016 |
| JP | 2017000539 | A | 1/2017 |
| KR | 19950000270 | | 1/1995 |
| KR | 19990074966 | | 10/1999 |
| KR | 100730948 | | 6/2007 |
| SE | 104383 | C1 | 4/1942 |
| SE | 9600650 | L | 8/1997 |
| WO | 0065978 | | 11/2000 |
| WO | 0065978 | A1 | 11/2000 |
| WO | 0197673 | A1 | 12/2001 |
| WO | 2005034706 | | 4/2005 |
| WO | 2007086798 | | 8/2007 |
| WO | 2008009583 | A1 | 1/2008 |
| WO | 2012117231 | A1 | 9/2012 |

OTHER PUBLICATIONS

Japanese Office Action with English translation dated Dec. 14, 2018, received in corresponding Japanese Application No. 2017-557209, 6 pgs.

English Translation of Korean Office Action dated Jul. 21, 2019, received in corresponding Korean Application No. 10-2019-7014642, 7 pgs.

Australian Examination Report dated May 17, 2019, received in corresponding Australian Application No. 2017352431, 3 pgs.

Canadian Office Action dated Jul. 17, 2019, received in corresponding Application No. 3,041,265, 6 pgs.

EP Search Report dated Sep. 18, 2019, received in EP Application No. 19173961.4, 7 pgs.

(56) References Cited

OTHER PUBLICATIONS

Chinese Office Action with English language summary, dated Oct. 21, 2019, received in Chinese Application No. 201711007647.7, 13 pgs.
Korean Office Action with English translation dated Jan. 22, 2020, received in KR Appliction No. 10-2019-7014642, 12 pgs.
European Extended Search Report dated Dec. 19, 2019, received in EP Application No. 17864455.5, 10 pgs.
Chinese Office Action with English translation dated Aug. 12, 2020, received in China Patent Application No. 201711007647.7, 13 pgs.
Japanese Office Action with English translation datd Aug. 24, 2020, received in Japanese Patent Application No. 2019-139822, 6 pgs.
Chinese Office Action with English translation dated Dec. 28, 2020, received in China Patent Application No. 201910917837.5, 11 pgs.
EP Examination Report dated Oct. 6, 2020, received in EP Application No. 17864455.5, 4 pgs.
EP Examination Report dated May 6, 2021, received in EP Application No. 17864455.5, 5 pgs.
PCT Search Report and Written Opinion, dated Sep. 13, 2022, received in corresponding PCT Application No. PCT/US2022/034078, 10 pages.
Australian Examination Report dated Nov. 8, 2022, received in Australian Patent Application No. 2020280983, 6 pages.
Japanese Office Action with English translation dated May 13, 2022, received in Japanese Patent Application No. 2021-083483, 5 pages.
Japanese Office Action with English translation dated Aug. 30, 2022, received in Japanese Patent Application No. JP2021-083483, 4 pages.
Australian Examination Report dated Feb. 15, 2022, received in Australian Patent Application No. 2020280983, 5 pages.
Communication of a Notice of Opposition against European Patent EP3566628B1 dated Apr. 17, 2023, 41 pages.
Consolidated List of References Cited in Notice of Opposition against EP3566628B1, 1 page.
D5 from Notice of Opposition—Specification of EP3566628B1 as originally filed, 28 pages.
D6 from Notice of Opposition—Specification of WO2018/080873 as originally filed, 27 pages.
D7 from Notice of Opposition—Track changes the text of EP3566628B1 as granted vs as originally filed, 17 pages.
D8 from Notice of Opposition—Track changes the text of EP3566628B1 as granted vs WO2018/080873 as originally filed, 19 pages.
U.S. Office Action dated Sep. 21, 2023, received in U.S. Appl. No. 17/843,709, 12 pages.

* cited by examiner

VACUUM CLEANING DEVICE WITH FOLDABLE WAND TO PROVIDE STORAGE CONFIGURATION

CROSS-REFERENCE TO RELATED APPLICATIONS

This application is a continuation of co-pending application Ser. No. 15/333,109 filed Oct. 24, 2016, which claims the benefit of U.S. Provisional Patent Application Ser. No. 62/245,206, filed on Oct. 22, 2015, all of which are fully incorporated herein by reference.

TECHNICAL FIELD

The present disclosure relates to vacuum cleaning devices and more particularly, to a vacuum cleaning device with a foldable wand to provide a storage configuration.

BACKGROUND INFORMATION

Vacuum cleaners devices are used in the home, office and other locations to treat floors and other surfaces. Some vacuum cleaners include a straight, rigid wand between a handle and a surface cleaning head that contacts a surface being cleaned. Some vacuum cleaners may also include a vacuum unit at an opposite end of the wand from the surface cleaning head. The rigidity of the wand often makes it more difficult to use the vacuum cleaner and to store the vacuum cleaner, particularly when a vacuum unit is attached to at an opposite end of the wand.

SUMMARY

Consistent with an embodiment, a vacuum cleaning device includes a vacuum unit including at least a suction motor, a surface cleaning head including a suction conduit, and a wand having a first end coupled to the vacuum unit and a second end coupled to the surface cleaning head. The wand defines an air passage extending from the first end to the second end and includes a flexible air passage along at least a portion of the wand. The wand includes a plurality of segments pivotably connected together such that the wand is foldable about 180° in a forward direction until the vacuum unit is positioned proximate a top of the surface cleaning head in a storage configuration.

Consistent with another embodiment, vacuum cleaning device includes a vacuum unit operable to generate vacuum-cleaning suction, a vacuum head, and a wand disposed between the vacuum head and the vacuum unit. The wand includes a plurality of pivotably connected segments. A flexible air passage defines an airway from the vacuum unit to the vacuum head, wherein the vacuum unit is operable to provide vacuum suction to the vacuum head.

BRIEF DESCRIPTION OF THE DRAWINGS

These and other features and advantages will be better understood by reading the following detailed description, taken together with the drawings wherein.

DETAILED DESCRIPTION

Vacuum cleaning devices, consistent with embodiments of the present disclosure, include foldable wands to provide a storage configuration and/or facilitate use. A vacuum cleaning device includes a wand having a first end coupled to a vacuum unit and a second end coupled to a vacuum head or surface cleaning head. The wand defines an air passage allowing air to pass from the surface cleaning head to the vacuum unit and includes a flexible air passage along at least a portion of the wand. The wand also includes a plurality of segments pivotably connected together such that the wand is foldable about 180° in a forward direction until the vacuum unit is positioned proximate a top of the surface cleaning head, thereby providing a storage configuration.

Figure 1A:
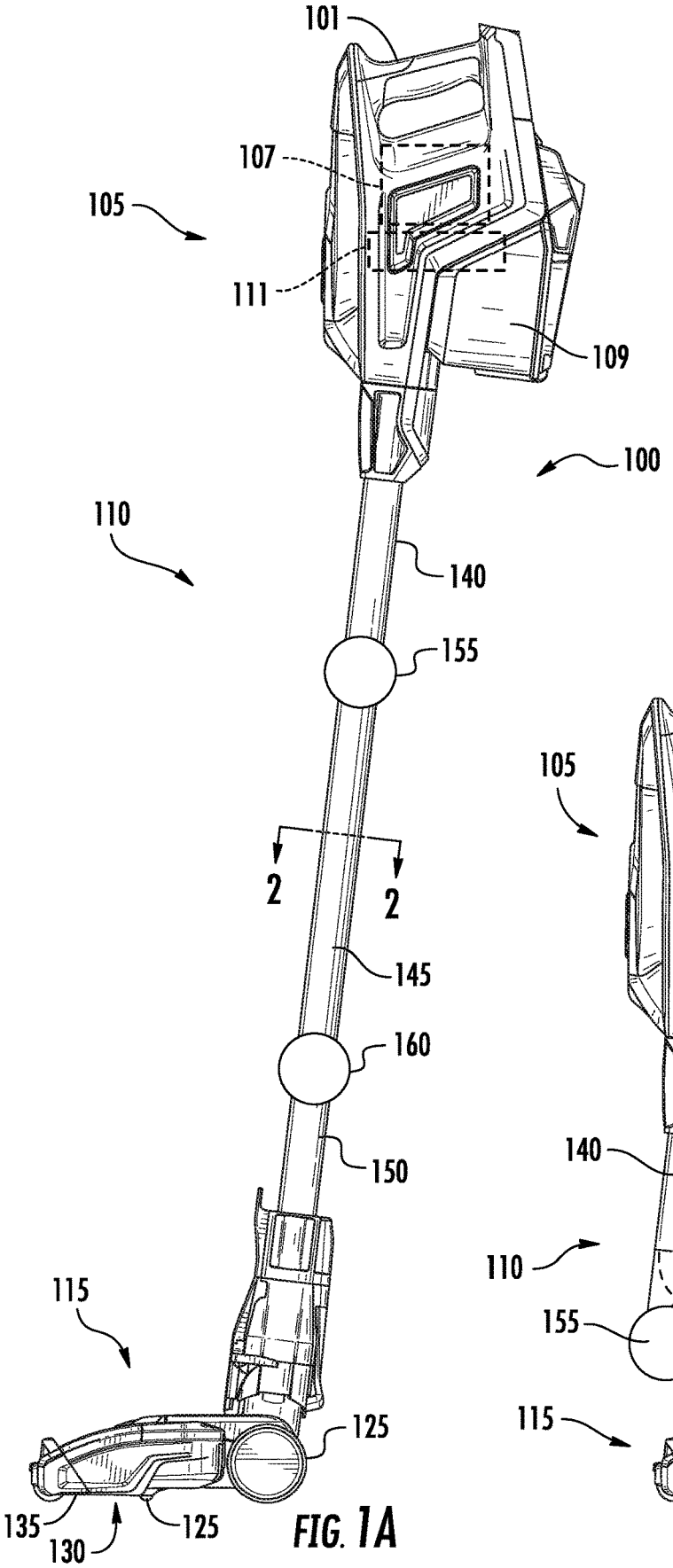
FIG. 1A is a side view of a vacuum cleaning device with a foldable wand in an upright configuration, consistent with embodiments of the present disclosure.
Figure 1B:
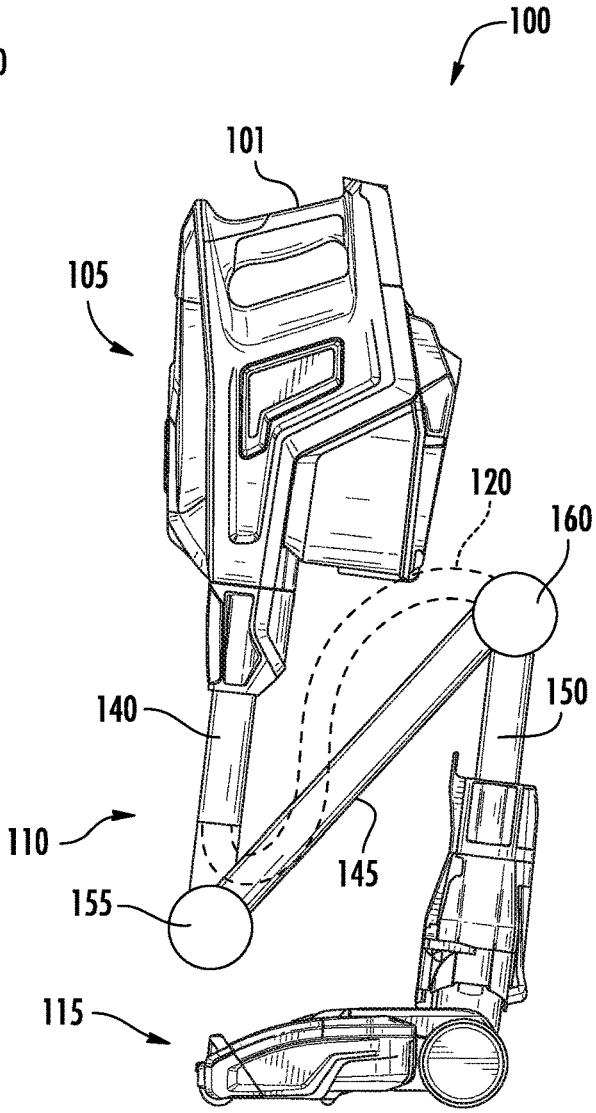
FIG. 1B is a side view of the vacuum cleaning device in FIG. 1A in a storage configuration.

FIGS. 1A and 1B depict an illustrative embodiment of a vacuum cleaning device 100 that may be used for cleaning or otherwise treating a floor surface, such as a carpet and/or hard floor. It should be appreciated that the vacuum cleaning devices described herein may be used as treatment devices or appliances that treat or operate on a surface to perform one or more functions.

As illustrated in FIGS. 1A and 1B, one embodiment of the vacuum cleaning device 100 includes a handle 101, a vacuum unit 105, a wand 110, a vacuum head or surface cleaning head 115, and a flexible air passage 120. The vacuum unit 105 may comprise any number of devices suitable for generating suction to pick up dirt, dust, debris and waste. In an embodiment, the vacuum unit 105 may include a motor 107 (shown schematically) for generating suction through a dust cup 109 and a filter 111 (shown schematically) disposed between the dust cup 109 and motor 107 for causing dust materials to be deposited in the dust cup 109. The vacuum unit 105 may be removably detachable from the wand 110 of the vacuum cleaning device 100. In such an embodiment, the vacuum unit 105 may be configured for use as a handheld vacuum when detached.

In some embodiments, the motor 107 may be electrically powered by connection to an electrical outlet, and in other embodiments, the motor 107 may be powered by a battery. The vacuum unit 105 may be integrally or removably attached to the handle 101. In an embodiment, the motor 107 may comprise any number of cyclone chambers (not shown), such as one, two, three, etc. In an embodiment, the vacuum unit 105 may include any number of dust cups 109, such as one, two, three, etc. Consistent with an embodiment to be discussed below, for example, the vacuum unit 105 may comprise two dust cups and two cyclones.

The vacuum head 115 provides the interface between the vacuum cleaning device 100 and the area targeted for vacuuming. Different embodiments of the vacuum cleaning device 100 may comprise different types of vacuum cleaning heads 115. In the embodiment shown in FIGS. 1A and 1B, the vacuum head 115 includes a roller system 125 rotatably coupled to a housing having a suction conduit opening or mouth 130 and a brush guard 135. The rollers 125 facilitate movement of the vacuum cleaning device 100. A variety of different types of roller systems 125 may be used in different embodiments. Other embodiments may employ different means to facilitate movement of the vacuum cleaning device 100.

The mouth 130 provides an opening where dust, dirt or other waste may be sucked into a suction conduit of the vacuum cleaning device 100. Different embodiments may employ different types of designs for the structure of the mouth 130. The mouth 130 may be defined in an assortment of shapes and sizes and may be divided into more than one opening. The brush guard 135 may also have a variety of different forms in different embodiments.

The vacuum cleaning device 100 fluidly connects the vacuum cleaning head 115 to the vacuum unit 105 by a flexible air passage 120 (hidden in FIG. 1A and shown in FIG. 1B). The suction created by the vacuum unit 105 can thereby be delivered to the vacuum cleaning head 115. Dirt, debris, and other waste can be picked up at the vacuum cleaning head 115 and sucked through the flexible air passage 120. The flexible air passage 120 may include a hose. Different hoses can be used in different embodiments, and other materials may also be used for the flexible air passage in alternative embodiments.

In an embodiment, the wand 110 of the vacuum cleaning device 100 is configured to be foldable or collapsible to allow for easy storage and easy expansion for use. In the embodiment shown in FIGS. 1A and 1B, the wand 110 may be connected between the vacuum unit 105 and the cleaning head 115 and defines an air passage including the flexible air passage 120 along at least a portion of the wand 110. The wand 110 may include a plurality of segments 140, 145, 150 pivotably connected to each other. In an embodiment, the wand 110 may include a first segment 140 pivotably connected to a second segment 145, which in turn, is pivotably connected to a third segment 150. In an embodiment, the pivot connections may be effected using a first hinge 155 disposed between the first segment 140 and the second segment 145, and a second hinge 160 disposed between the second segment 145 and the third segment 150.

The first hinge 155 may be configured to give the first segment 140 a range of motion around an axis of rotation centered at the first hinge 155. Similarly, the second hinge 160 may be configured to give the second segment 145 a range of motion around an axis of rotation centered at the second hinge 160. This allows a user the ability to reshape the vacuum cleaning device 100 for storage or other purposes. Alternatively or additionally, joints, axles, or bearings may be used to pivotably connect the segments.

Some embodiments of the vacuum cleaning device 100 may have fewer than three segments or more than three segments, such as two, four, five, six, etc. Different embodiments may also include different number of hinges or joints to allow the segments a range of motion. Some embodiments may only have one hinge thereby giving one segment a range of motion, as will be described in greater detail below.

In some embodiments, the first hinge 155 may be configured to limit the range of motion of the first segment 140 to a predetermined angle of displacement (not shown), such as 90 degrees or 180 degrees. In some embodiments the second hinge 160 may be configured to limit the range of motion of the second segment 145 to a predetermined angle of displacement (not shown), such as 90 degrees or 180 degrees. In some embodiments, both hinges may be configured to limit the range of motion for each segment.

The angle of displacement for the first hinge 155 may be in the opposite direction as the angle of displacement for the second hinge 160, for example, as shown in FIG. 1B. In this embodiment, the second segment 145 is rotated forward and the first segment 140 is rotated backwards. As a result, the handle 101 in this embodiment is facing upwards towards a user so that it can conveniently be grabbed.

In an alternative embodiment not shown, the second segment 145 may be rotated backwards and the first segment 140 may be rotated forward. The handle 101 in this embodiment will also face upward so that it can easily be grabbed by a user. In other embodiments, the first segment 140 and/or the second segment 145 may be able to rotate forwards and backwards.

Figure 4:
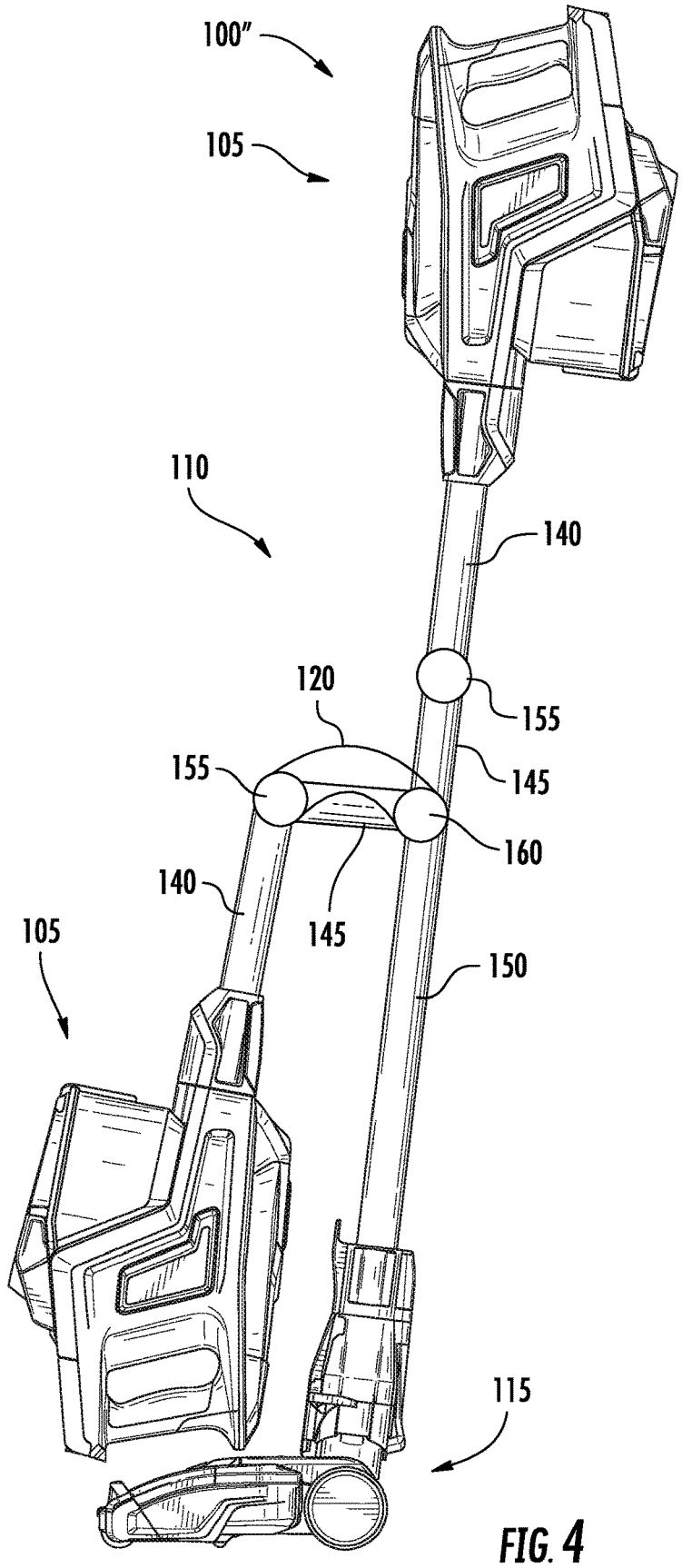
FIG. 4 is a side view of a further embodiment of a vacuum cleaning device with a foldable wand.

The angle of displacement for the first hinge 155 may be in the same direction as the angle of displacement for the second hinge 160 in some embodiments, for example, as shown in FIG. 4. This permits the first segment 140 to be folded over so that it may be conveniently stored. Some embodiments may also include an additional handle (not shown) or a detachable handle (not shown) so that the first segment 140 may be easily transferred from one position to the next.

The vacuum cleaning device 100 may also include a locking mechanism (not shown in FIGS. 1A and 1B) to secure the first segment 140 and the second segment 145 into place. Different types of locking mechanisms may be used in different embodiments. Some embodiments may employ a push-button release system to unlock the locking mechanism and free the first segment 140 and second segment 145 for rotation. The push-button release may be actuated by a foot pedal in some embodiments. In some embodiments, both segments may be automatically unlocked simultaneously. In other embodiments, the first segment 140 and the second segment 145 may be unlocked independently.

In some embodiments, the vacuum cleaning device 100 may have pre-set positions where the first 140 and second segment 145 automatically lock into place. In one embodiment, a first position may correspond to an upright mode where the first segment 140, second segment 145 and third segment 150 are in vertical alignment. Other embodiments may also have other positions.

Figure 2:
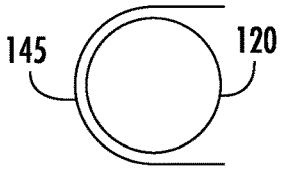
FIG. 2 is a cross-sectional view of a mid-section of the wand taken along line 2-2 in FIG. 1A.

The flexible air passage 120 may include a flexible hose extending at least along the second segment 140. As shown in FIG. 2, the second segment 145 may have a U-shaped cross-section such that the flexible air passage 120 is received within the second segment 145 but can move independently from the second segment 145 when pivoted. Because the flexible air passage 120 is not constrained by the second segment 145, the segments 140, 145, 150 may be pivoted to a storage configuration (FIG. 1B) while the flexible air passage 120 flexes and remains connected.

Figure 3:
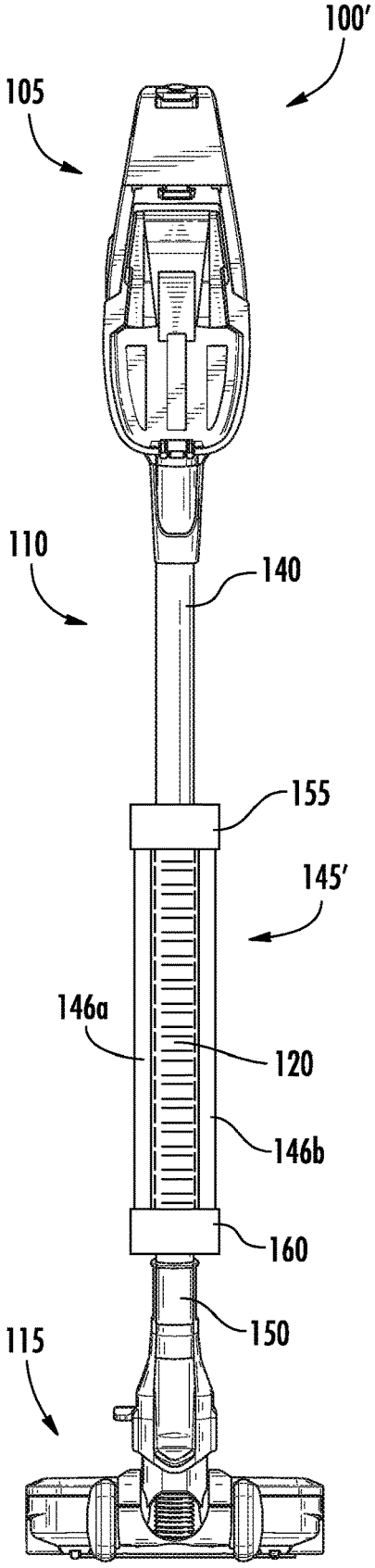
FIG. 3 is a rear view of another embodiment of a vacuum cleaning device with a foldable wand.

As shown in FIG. 3, another embodiment of the vacuum cleaning device 100' includes a second segment 145' with two sides 146*a*, 146*b* on each side of the flexible air passage 120 and between the hinges 155, 160. This embodiment of the vacuum cleaning device 100' may be moved to a storage configuration similar to the vacuum cleaning device 100 as shown in FIG. 1B, allowing the flexible air passage 120 to flex between the sides 146*a*, 146*b*.

Referring to FIG. 4, another embodiment of a vacuum cleaning device 100" includes a foldable wand 110 that pivots forwardly about 180° such that the vacuum unit 105 is positioned proximate the vacuum head 115, providing a storage configuration. This embodiment of the vacuum cleaning device 100" is similar to the vacuum cleaning device 100 shown in FIGS. 1A and 1B, but the second segment 145 is shorter and the hinge 155 allows pivoting in a forward direction.

Figure 5:
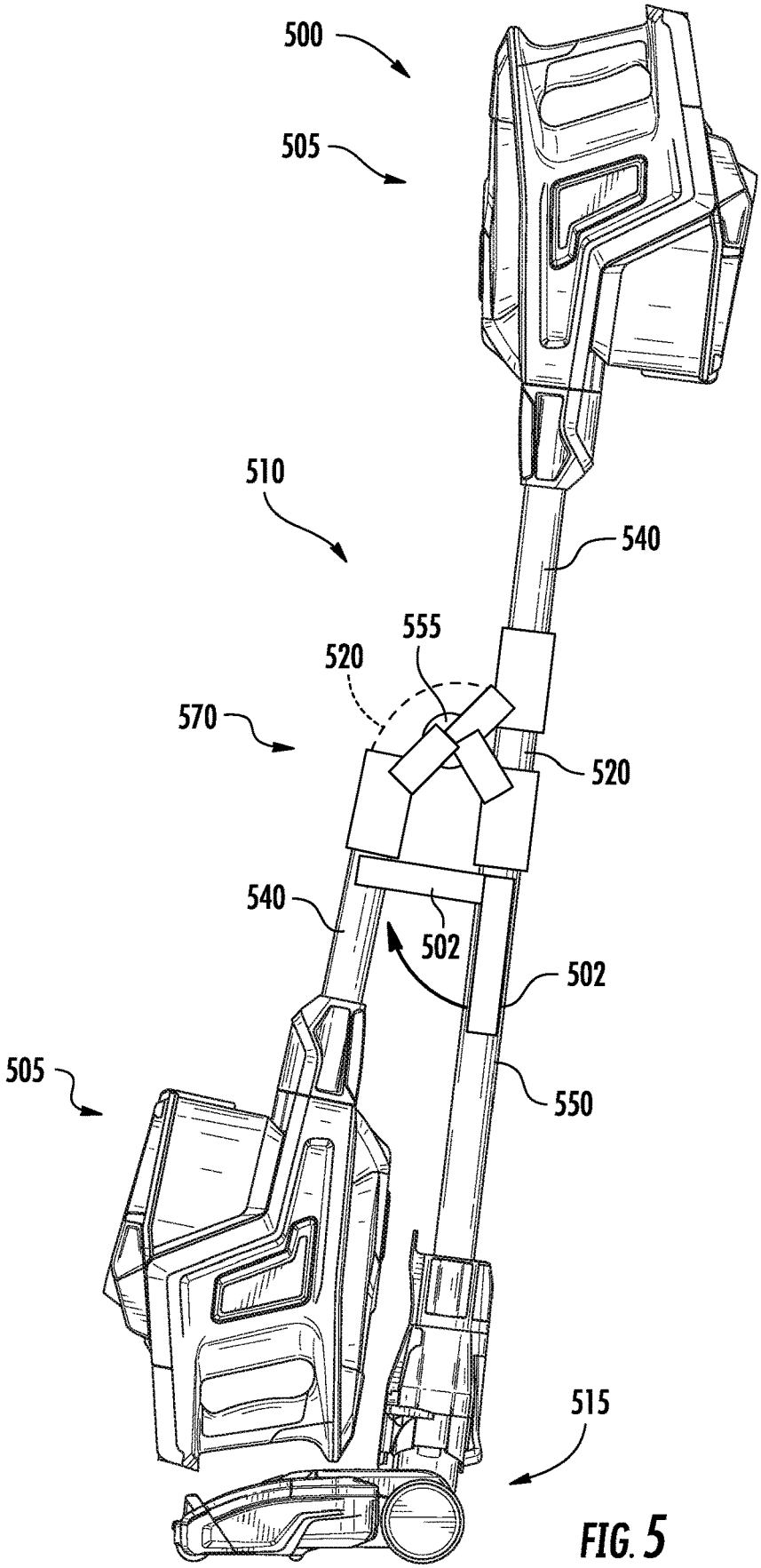
FIG. 5 is a side view of yet another embodiment of a vacuum cleaning device with a foldable wand showing both the upright configuration and the storage configuration.

Referring to FIG. 5, a further embodiment of a vacuum cleaning device 500 with a foldable wand is shown and described. The vacuum cleaning device 500 includes a vacuum unit 505, wand 510 and vacuum head or surface cleaning head 515, for example, as described above. In this embodiment, the wand 510 includes first and second rigid segments 540, 550 with a flexible air passage 520 (e.g., hose) extending therebetween. The flexible air passage 520 may extend only between the segments 540, 550 or may extend within the segments 540, 550 to the vacuum unit 505 and the surface cleaning head 515. This embodiment of the vacuum cleaning device 500 includes a single hinge 555 pivotably coupled to both of the segments 540, 550, forming a bendable wand joint 570.

The segments 540, 550 may thus be pivoted about the hinge 555 to bend or fold the wand 510 with the flexible air passage 520 flexing between the segments 540, 550. In the illustrated embodiment, the flexible wand joint 570 allows the wand 510 to be folded about 180° such that the vacuum unit 505 is positioned proximate a top of the surface cleaning head 515 in a storage configuration, as shown. This provides for a lower center of gravity in the storage configuration to facilitate handling and storage of the vacuum cleaning device 500. The flexible wand joint 570 also allows the wand to bend during use, for example, to allow the wand to be lowered without requiring the user to bend over as much. This may prevent strain on the back of the user during use.

The vacuum cleaning device 500 may also include an additional handle 502 that may be used in the storage configuration. In some embodiments, as shown, the additional handle 502 is coupled between the segments 540, 550 in the storage configuration. The additional handle 502 may be pivotably mounted on one segment 550 and then pivoted into engagement with the other segment 540.

Figure 13:
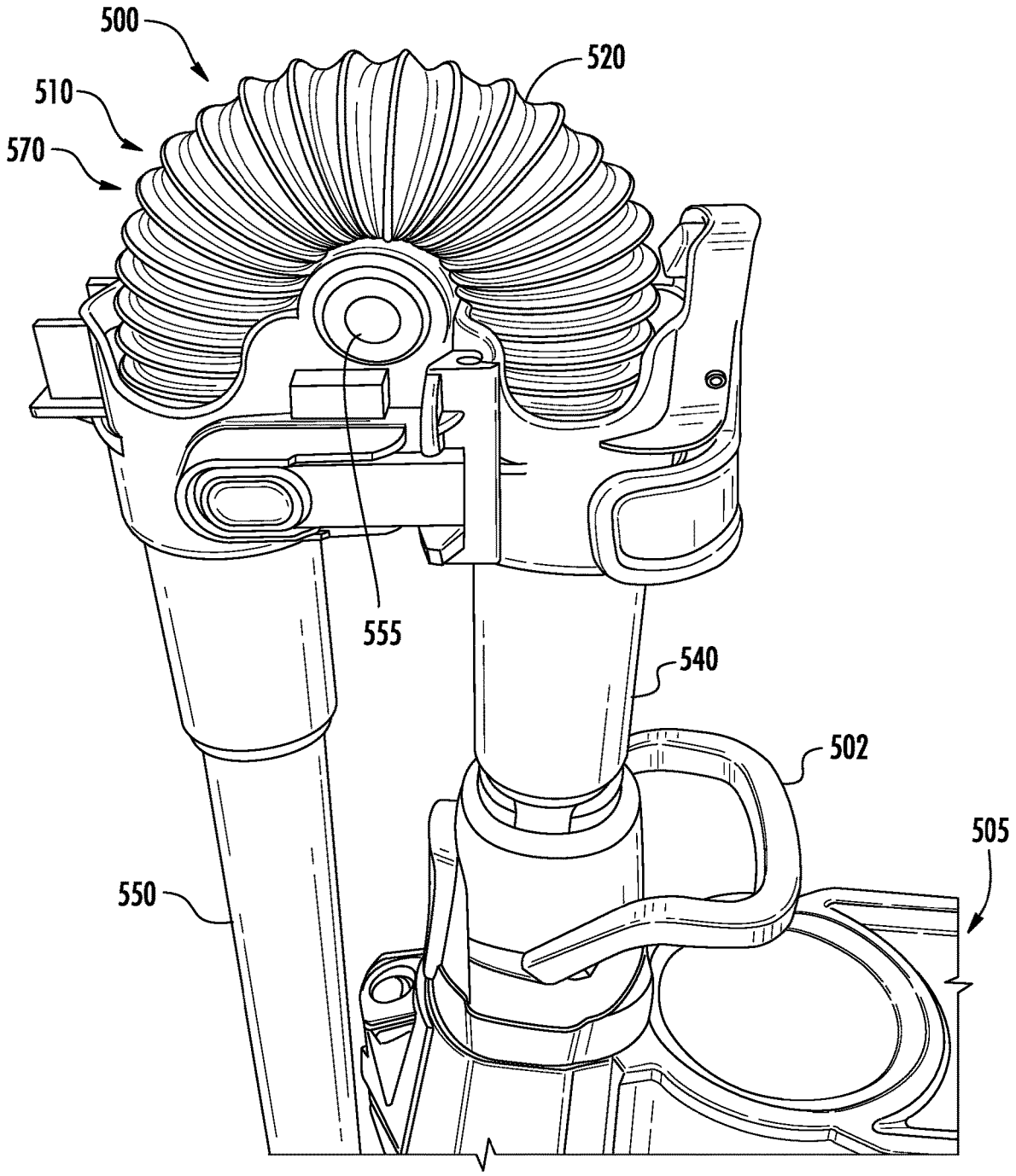
FIG. 13 illustrates one embodiment of a vacuum cleaning device including an additional handle.
Figure 14:
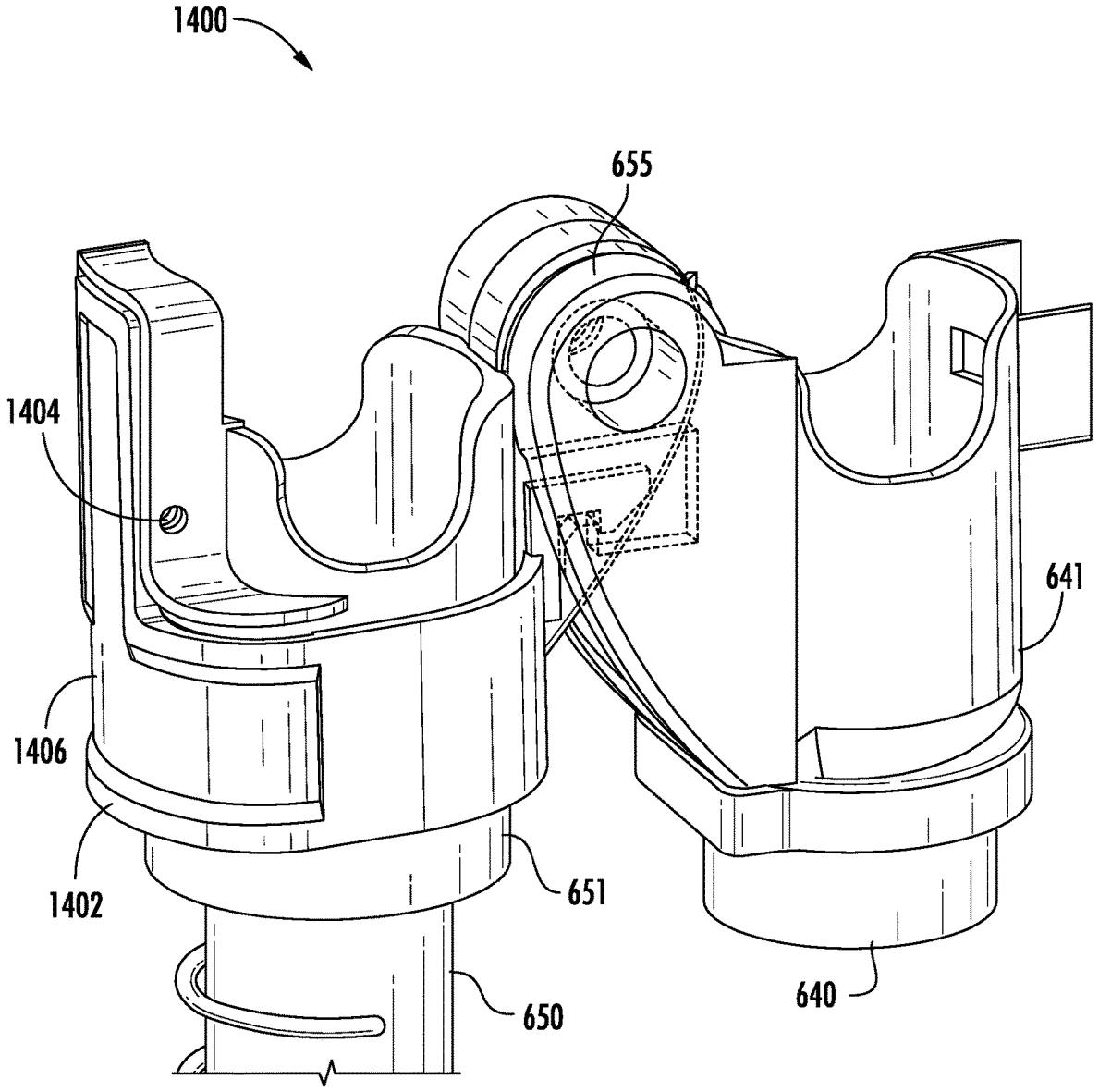
FIG. 14 is a partially transparent side view illustrating one embodiment of a single locking mechanism for securing the vacuum cleaning device in a straight position and a storage position.
Figure 15:
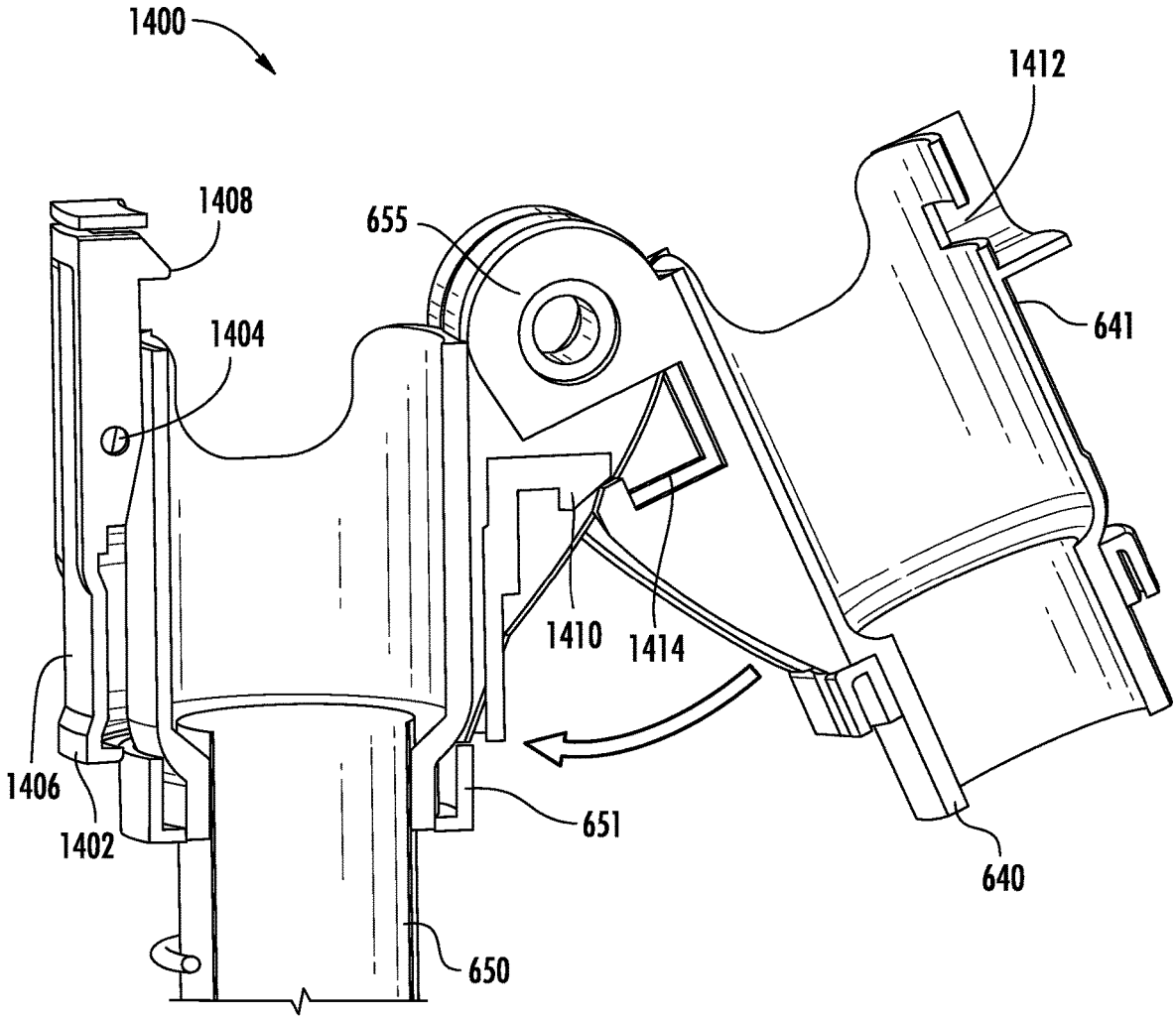
FIG. 15 is a cross-sectional view of the single locking mechanism of FIG. 14 for securing the vacuum cleaning device in a straight position and a storage position in an intermediate position.
Figure 16:
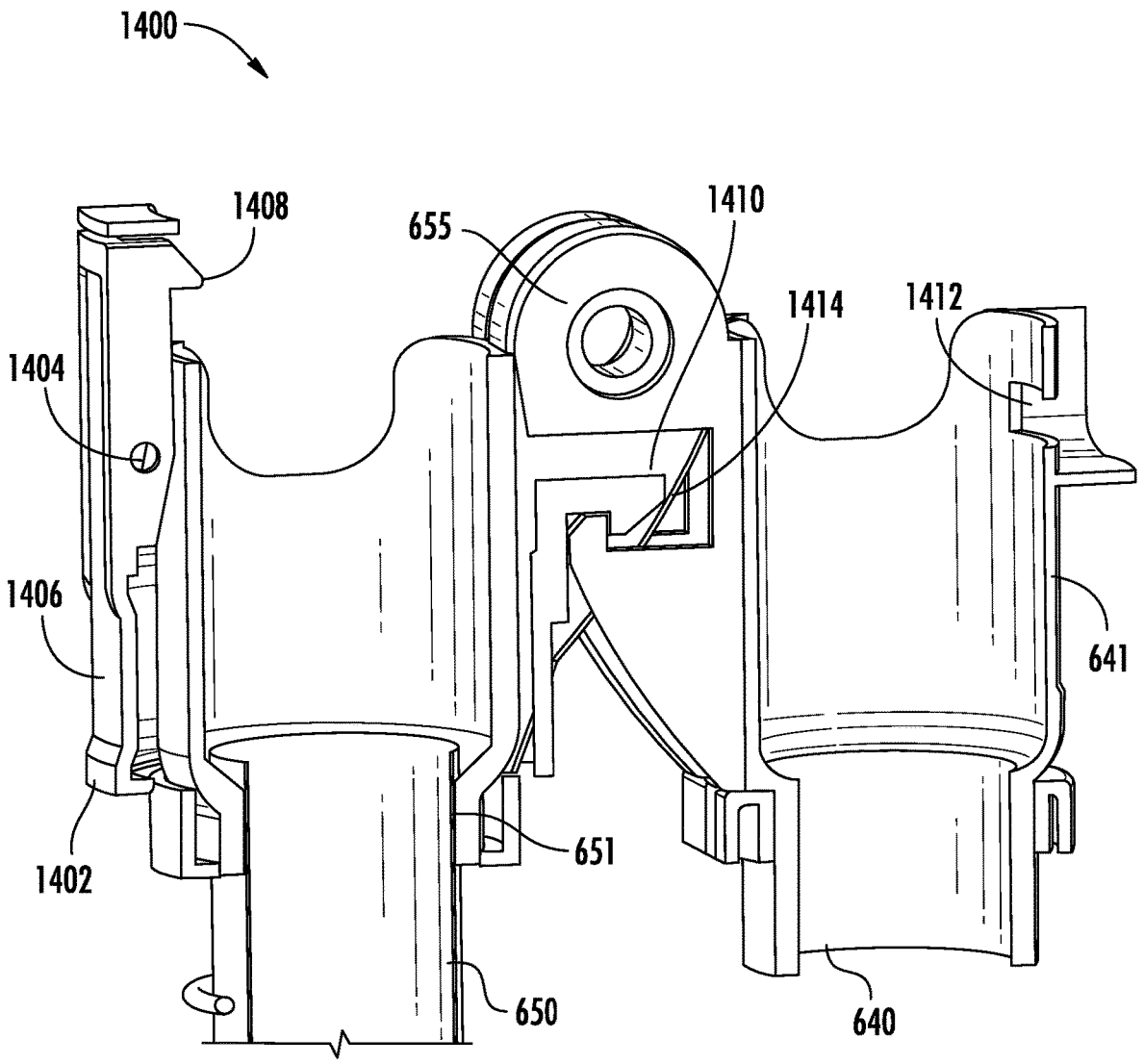
FIG. 16 is a cross-sectional view of the single locking mechanism of FIG. 14 for securing the vacuum cleaning device in a straight position and a storage position in a locked, storage position.
Figure 17:
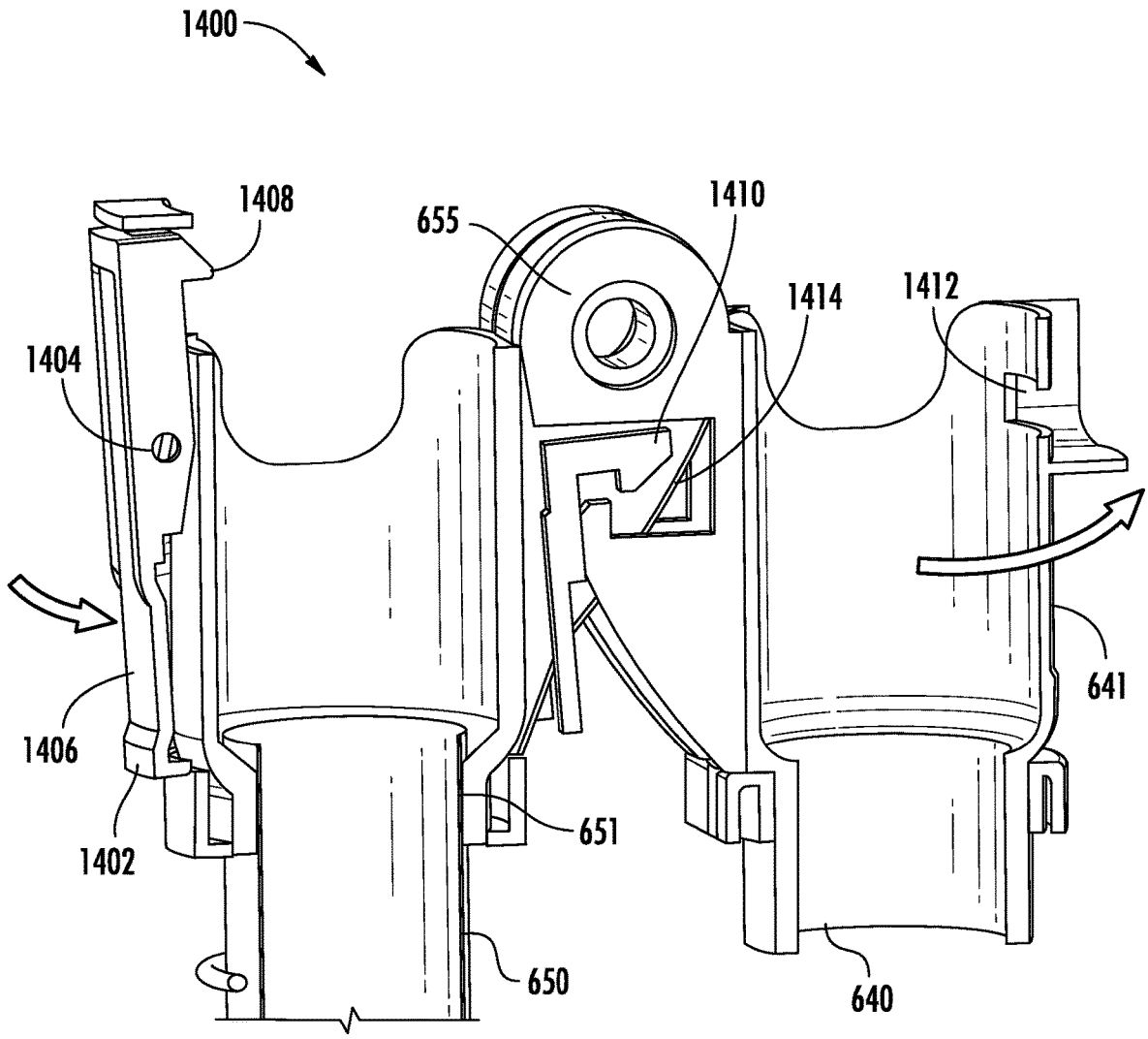
FIG. 17 is a cross-sectional view of the single locking mechanism of FIG. 14 for securing the vacuum cleaning device in a straight position and a storage position in a unlocked, storage position.
Figure 18:
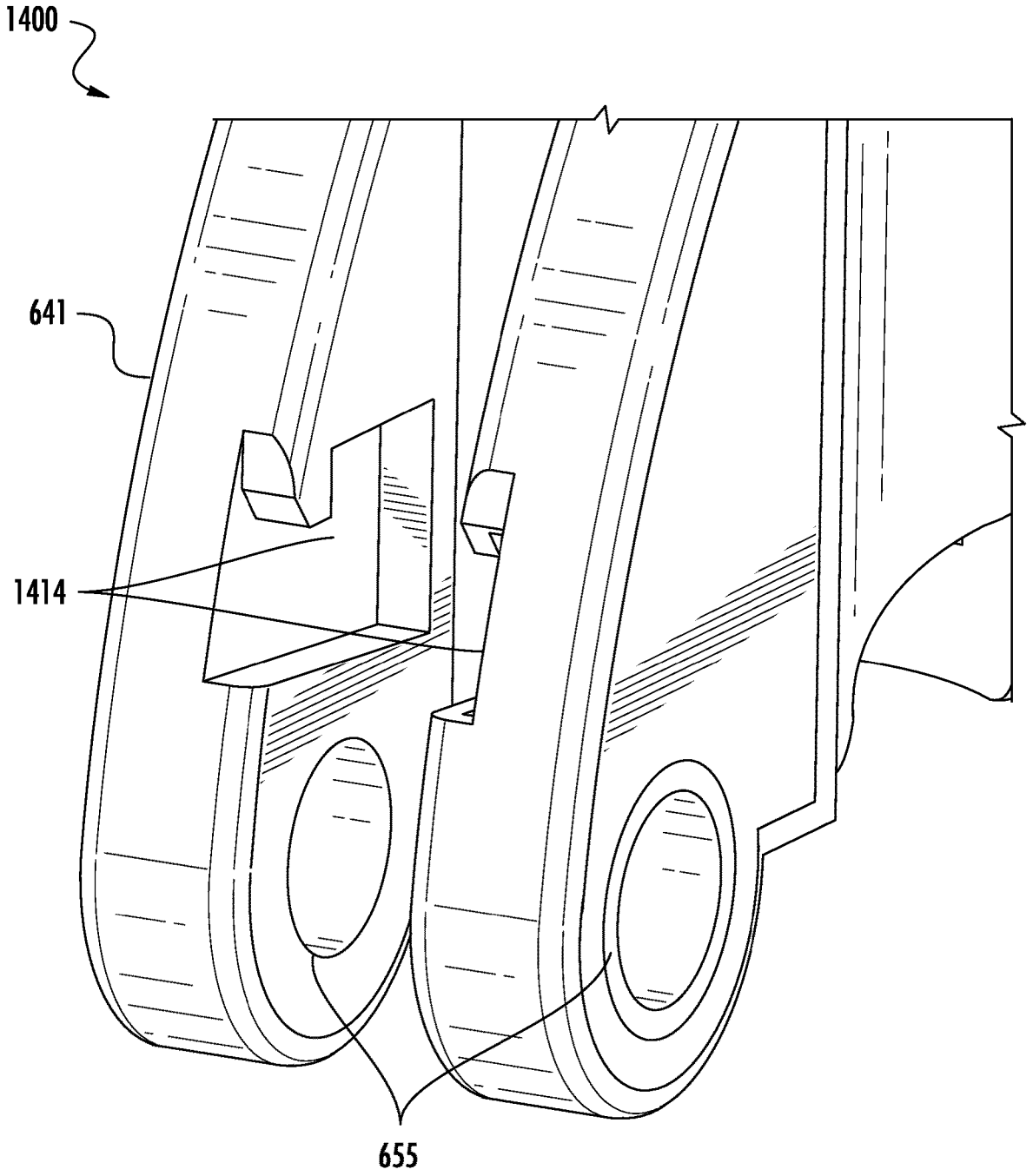
FIG. 18 is a side, end view of illustrating one embodiment of a locking cavity.

One example of an additional handle 502 consistent with at least one embodiment of the present disclosure is generally illustrated in FIG. 13. As may be seen, the addition handle 502 may be coupled to and/or located proximate to at least a portion of the first segment 540. For example, the additional handle 502 may extend from a first to an opposite side (e.g., a left to a right side), and may be located proximate the vacuum unit 505 (e.g., closer to the vacuum unit 505 than the single hinge 555). This location of the additional handle 502 location provides numerous unexpected benefits. For example, the location of the additional handle 502 is lower down on the vacuum cleaning device 500 when in the folded position of FIG. 13, thereby allowing users to lift the vacuum cleaning device 500 off the ground more easily, particularly if the user is shorter. The location of the additional handle 502 also at the preferred height when the vacuum cleaning device 500 is folded to facilitate carrying the vacuum cleaning device 500 up stairs. Moreover, the location of the additional handle 502 allows for a wider carrying surface as the bulk of the additional handle 502 is hidden by the connector when looking front on. The joint remains slim from the front as most of the bulk of the additional handle 502 is at the top. The location of the additional handle 502 facilitates lifting the vacuum cleaning device 500 from the folded (e.g., storage) position to the straight position. Without a lifting handle 502, users may unfold the vacuum cleaning device 500 from the handvac handle (which undesirably requires a user to bend to the floor), the dustcup (which is uncomfortable and may lead to accidental dustcup release), and/or the pole (not intuitive and higher lever forces so wanted to hold lower down). As noted, all of these alternative methods suffer from disadvantages which the additional handle 502 in the location of FIG. 13 addresses.

As mentioned above, the vacuum unit 515 may be battery powered or may be connectable to an external power source by a cord. The vacuum unit 515 may include a rechargeable battery, which may be charged when in the storage configuration and without removing the vacuum unit 515. For example, the charging contacts or connection on the vacuum unit 515 may be in a position on the vacuum unit 505 that allows the vacuum unit 515 to be connected to a charging unit when in the storage configuration.

Figure 6A:
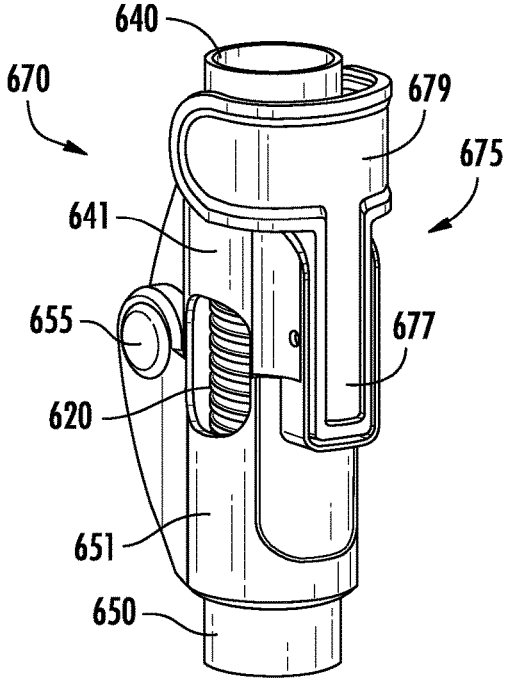
FIG. 6A is a perspective view of an embodiment of a bendable wand joint that may be used in the vacuum cleaning device shown in FIG. 5.
Figure 6B:
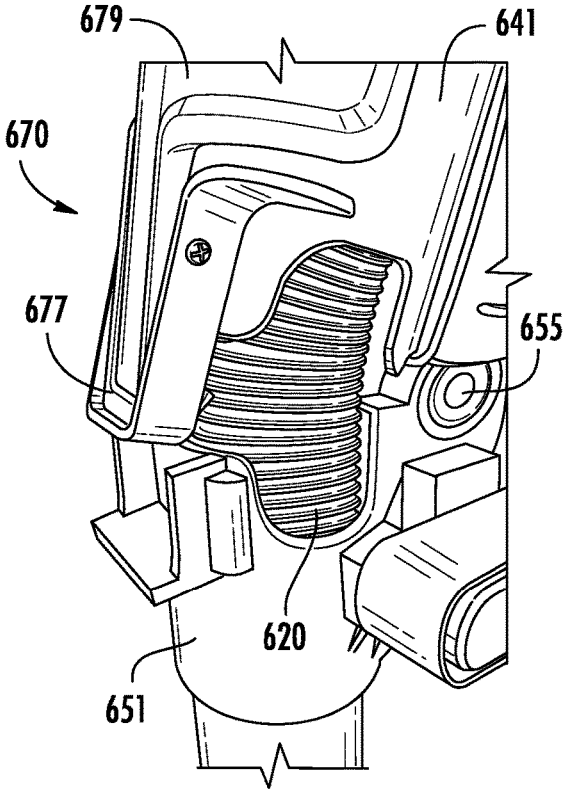
FIGS. 6B-6D are photographs illustrating the bendable wand joint in FIG. 6A in different bending positions.
Figure 6C:
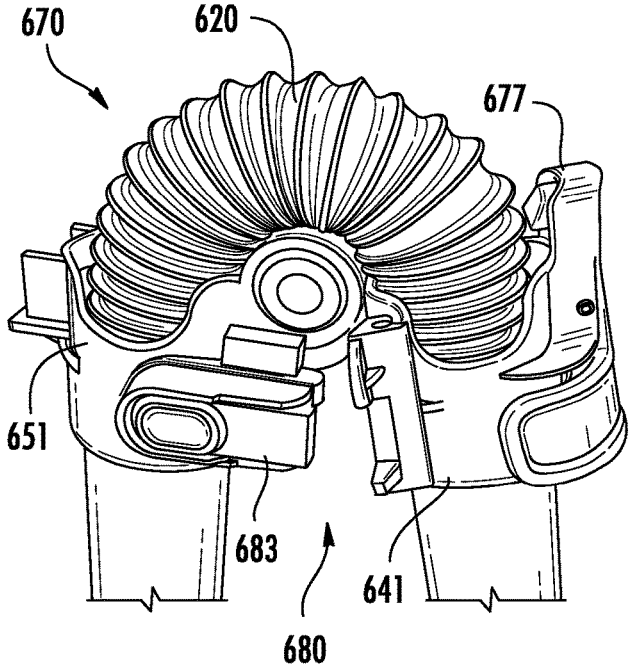
Figure 6D:
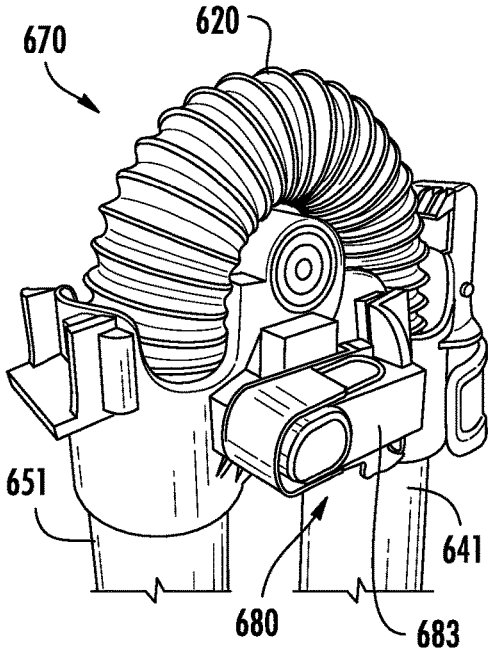
Figure 7A:
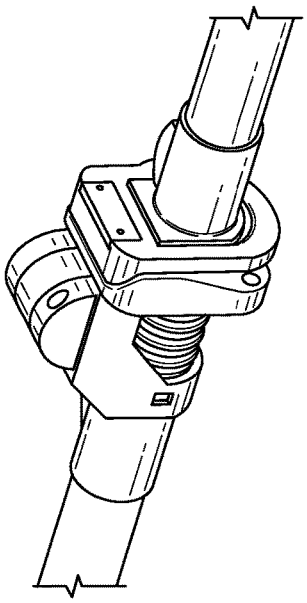
FIGS. 7A-7C are perspective, side and back views, respectively, of another embodiment of a bendable wand joint that may be used in the vacuum cleaning device shown in FIG. 5.
Figure 7B:
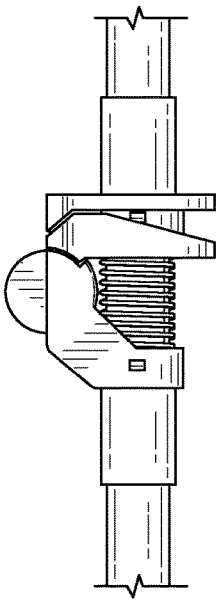
Figure 7C:
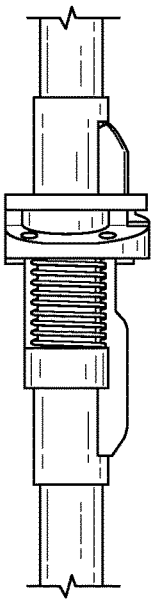
Figure 8A:
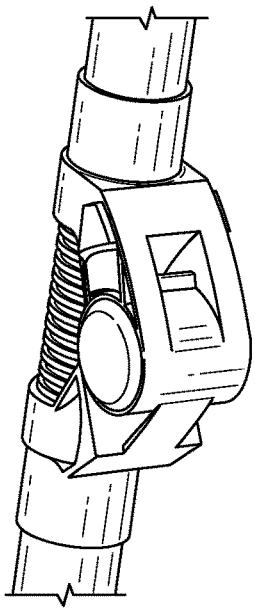
FIGS. 8A and B are perspective and side views, respectively, of a further embodiment of a bendable wand joint that may be used in the vacuum cleaning device shown in FIG. 5.
Figure 8B:
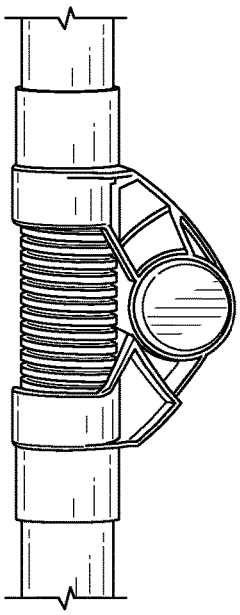
Figure 9A:
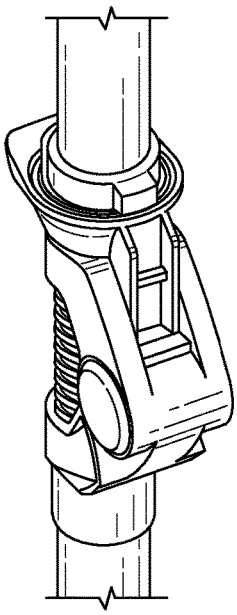
FIGS. 9A and 9B are perspective and side views, respectively, of yet another embodiment of a bendable wand joint that may be used in the vacuum cleaning device shown in FIG. 5.
Figure 9B:
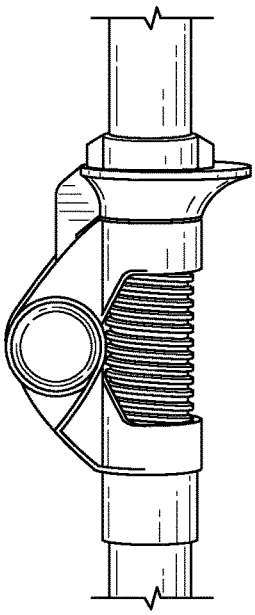

An embodiment of a bendable wand joint 670 that may be used with the vacuum cleaning device 500 is shown in greater detail in FIGS. 6A-6D. The bendable wand joint 670 includes a first hinge member 641 at an end of a first wand segment 640 and a second hinge member 651 at the end of a second wand segment 650. The hinge members 641, 651 are pivotably coupled at hinge 655. A flexible hose 620 extends between the hinge members 641, 651 and wand segments 640, 650. When the hinge members 641, 651 pivot about the hinge 655, the flexible hose 620 flexes as shown in FIGS. 6C and 6D.

A first locking mechanism 675 may hold the hinge members 641, 651 together to lock the bendable wand joint 655 (e.g., in an extended or straight position as shown in FIG. 6A). This embodiment of the locking mechanism 675 includes a locking arm 677 extending from one hinge member 641 to engage a structure on the other hinge member 651. The first locking mechanism 675 may include a release button 679, which may be pressed to cause the locking arm 677 to disengage and unlock, as shown in FIG. 6B.

A second locking mechanism 680 may hold the hinge members 641, 651 together to lock the bendable wand joint 655 in a different position (e.g., in a folded position for a storage configuration as shown in FIG. 6D). This embodiment of the second locking mechanism 680 includes a locking arm 683 that extends from one hinge member 651 to engage a structure on the other hinge member 641. Other locking mechanisms may also be possible and are within the scope of the present disclosure.

With reference now to FIGS. 14-18, another embodiment of a locking mechanism 1400 is generally illustrated. As explained herein, the locking mechanism 1400 is a single locking mechanism that performs the locking functions of both the first locking mechanism 675 and the second locking mechanism 680, i.e., the locking mechanism 1400 may hold the hinge members 641, 651 together to lock the bendable wand joint 655 in an extended or straight position) and may also hold the hinge members 641, 651 together to lock the bendable wand joint 655 in a folded position for a storage configuration. It should be appreciated that the bendable joint 655 may include a flexible hose 620 (not shown in FIGS. 14-18 for clarity) that is similar to the flexible hose 620 of FIG. 6.

The locking mechanism 1400 includes a locking collar or the like 1402 which may be pivotally coupled to the second hinge member 651 about a pivot point 1404 (though it should be appreciated that locking collar 1402 may be pivotally coupled to the first hinge member 541). The locking collar 1402 may include at least one release button 1406 and a first and a second locking arm 1408, 1410. In the illustrated embodiment, the locking arms 1408, 1410 are configured to mechanically engage with a first and a second corresponding locking cavity 1412, 1414 formed in the first hinge member 641 (again, it should be appreciated that this arrangement may be reversed if the collar 1402 was pivotally coupled to the first hinge member 641) to secure (e.g., lock) the hinge members 641, 651 in the straight position and storage positions, respectively. According to one embodiment, the locking arms 1408, 1410 may include a locking pawl, hook, or the like that latches with a portion of the corresponding locking cavity 1412, 1414 to secure the first and second hinge members 641, 651 in the desired position (e.g., straight or folded positions). Optionally, the locking collar 1402 may include a biasing device (such as, but not limited to a spring or the like, not shown for clarity) that urges the locking collar 1402 to a default locking position. The default locking position may correspond to a position in which the locking arms 1408, 1410 are secured to the corresponding locking cavity 1412, 1414 when in either the straight or folded positions, respectively.

To move the hinge members 641, 651 from the current position to the alternative position, the user may press (e.g., urge) the release button 1406 inwardly against the biasing device which causes the locking arms 1408, 1410 to pivot and release from its respective locking cavity 1412, 1414, thereby allowing the user to move hinge members 641, 651 from one position to the other. Once in the new position, the locking arm 1408, 1410 corresponding to the new position will mechanically engage (e.g., lock) with the corresponding locking cavity 1412, 1414.

In at least one embodiment, the back saver of the present disclosure may be configured to automatically lock when folded into the storage position and automatically unlock by applying sufficient force (e.g., outward force) to lift the back saver out of the storage position into the use position (e.g., straight position).

FIGS. 7A-7C, 8A-8B, and 9A-9B illustrate other embodiments of bendable wand joints that may be used with the vacuum cleaning device 500 shown in FIG. 5. In further embodiments, the vacuum cleaning device 500 with a foldable wand shown in FIG. 5 may also be implemented using a reconfigurable airflow wand as described in U.S. Pat. No. 8,296,901, which is commonly owned and fully incorporated herein by reference.

Figure 12:
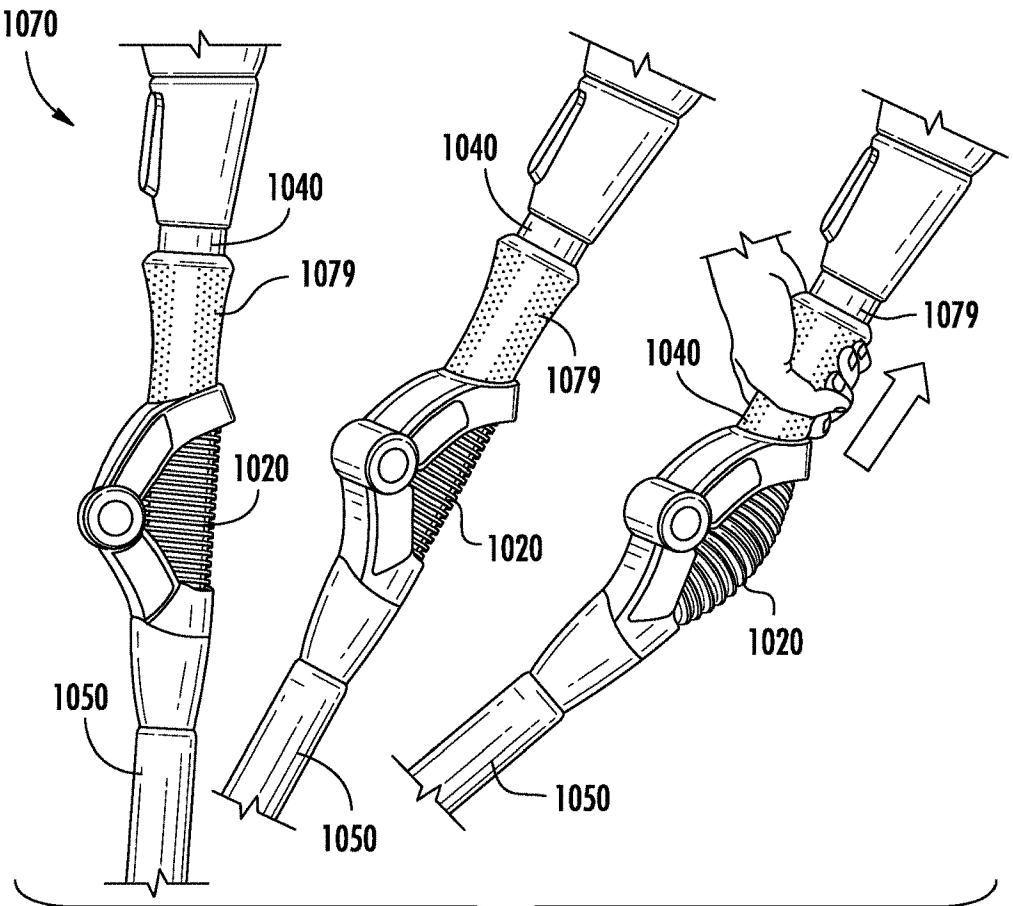
FIG. 12 illustrates bending of the bendable wand joint shown in FIG. 11.
Figure 11:
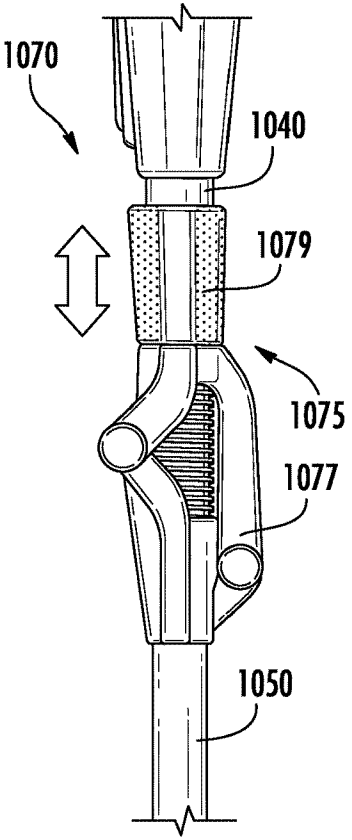
FIG. 11 is a side view of a bendable wand joint used in the vacuum cleaning device shown in FIG. 11.
Figure 10:
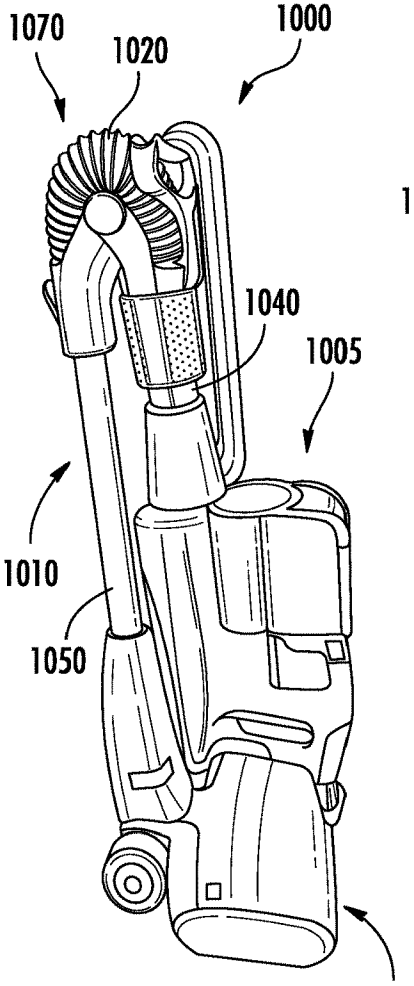
FIG. 10 is a side perspective view of a further embodiment of a vacuum cleaning device with a foldable wand.

Referring to FIGS. 10-12, a further embodiment of a vacuum cleaning device 1000 with a bendable wand is shown and described. In this embodiment, the vacuum cleaning device 1000 includes a bendable wand joint 1070 including a locking mechanism 1075 with a sliding actuator 1079 for releasing a locking arm 1077. As described above, the bendable wand joint 1070 is located between segments 1040, 1050 of a wand 1010. The wand segments 1040, 1050 are coupled to a vacuum unit 1005 and a surface cleaning head 1015, respectively, and a flexible hose 1020 extends at least between the wand segments 1040, 1050. The sliding actuator 1079 may include an over-molded sleeve around the wand segment 1040. The user may pull the sleeve of the sliding actuator 1079 toward the vacuum unit 1005 to cause the locking arm 1077 to release and allow the bendable wand joint 1070 to bend. As shown in FIG. 10, the bendable wand joint 1070 allows the wand segments 1040, 1050 to pivot about 180° such that the vacuum unit 1005 may be positioned proximate a top of the surface cleaning head 1015 in a storage configuration.

Accordingly, a vacuum cleaning device with a bendable wand, consistent with the present disclosure, may help reduce back strain during use while also facilitating storage.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result. Words relating to relative position of elements such as "about," "near," "proximate to," and "adjacent to" shall mean sufficiently close to have a material effect upon the respective system element interactions.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaning device comprising:

a wand having a first end configured to be coupled to a vacuum unit and a second end configured to be coupled to a surface cleaning head, the wand defining an air passage extending from the first end to the second end, the wand comprising:

a first and a second rigid wand segment defining a first and a second portion of said air passage;

a bendable wand joint comprising a hinge and a first and a second hinge member configured to pivotally connect said first and said second rigid wand segments together in multiple configurations, said multiple configurations comprising:

an extended position in which said first and said second rigid segments are axially aligned relative to each other during use; and a storage configuration in which said first and said second rigid segments are axially offset relative to each other during use; and a flexible air passage along at least a portion of the wand between said first and said second rigid segments defining a flexible air portion of said air passage and configured to flex when said first and said second hinge members pivot; and a locking mechanism configured to selectively lock the first and second segments in said extended position and said storage position, said locking mechanism including:

a first and a second locking arm, wherein the first locking arm locks the first and the second rigid wand segment in the extended position and the second locking arm locks the first and the second rigid wand segment in the storage configuration; and a single actuator for actuating both the first and second locking arms, the single actuator including a locking collar pivotally coupled to one of the first or second hinge members, wherein the locking collar is configured to pivot relative to the other of the first or second hinge members when the said first and said second hinge members pivot.

2. The vacuum cleaning device of claim 1, wherein the first and the second rigid wand segment are configured to be folded about 180° in a forward direction when transitioning from the extended position to the storage configuration.

3. The vacuum cleaning device of claim 1, wherein the locking mechanism is further configured to simultaneously actuate both the first and the second locking arm.

4. The vacuum cleaning device of claim 1, wherein the first locking arm is pivotally coupled to the first hinge member.

5. The vacuum cleaning device of claim 4, wherein the second locking arm is pivotally coupled to the first hinge member.

6. The vacuum cleaning device of claim 4, wherein the single actuator is disposed on the first hinge member.

7. The vacuum cleaning device of claim 1, wherein the first locking arm includes a first pawl or hook that latches with a first cavity formed in the second hinge member.

8. The vacuum cleaning device of claim 7, wherein the second locking arm includes a second pawl or hook that latches with a second cavity formed in the second hinge member.

9. The vacuum cleaning device of claim 1, wherein at least one of said first locking arm, said second locking arm, or said actuator are disposed on an opposite side of said wand than said hinge.

10. The vacuum cleaning device of claim 1, wherein the single actuator includes at least one release button.

11. The vacuum cleaning device of claim 10, wherein the locking collar includes a biasing device configured to urge the locking collar to a default locking position.

12. The vacuum cleaning device of claim 11, wherein the default locking position corresponds to a position in which the first and the second locking arm are secured to corresponding locking cavities when in either the extended position or storage configuration, respectively.

13. The vacuum cleaning device of claim 1, further comprising said vacuum unit.

14. The vacuum cleaning device of claim 1, further comprising said surface cleaning head.

15. A vacuum cleaning device comprising:

a wand having a first end configured to be coupled to a vacuum unit and a second end configured to be coupled to a surface cleaning head, the wand defining an air passage extending from the first end to the second end, the wand comprising:

a first and a second rigid wand segment defining a first and a second portion of said air passage;

a bendable wand joint comprising a hinge pivotally connecting said first and said second rigid wand segments together in multiple configurations, said multiple configurations comprising:

an extended position in which said first and said second rigid segments are axially aligned relative to each other during use; and a storage configuration in which said first and said second rigid segments are axially offset relative to each other during use; and a flexible air passage along at least a portion of the wand between said first and said second rigid segments defining a flexible air portion of said air passage; and a locking mechanism including a first locking arm, a second locking arm, a first locking position, and a second locking position, wherein when the locking mechanism is in the first locking position, the first locking arm locks the first and the second rigid wand segment in the extended position and the second locking arm is disengaged, and wherein when the locking mechanism is in the second locking position, the second locking arm locks the first and the second rigid wand segment in the storage configuration and the first locking arm is disengaged; and a single actuator for actuating both the first and second locking arms.

16. The vacuum cleaning device of claim 15, wherein the first and the second rigid wand segment are configured to be folded about 180° in a forward direction when transitioning from the extended position to the storage configuration.

17. The vacuum cleaning device of claim 15, wherein the locking mechanism is further configured to simultaneously actuate both the first and the second locking arm.

18. The vacuum cleaning device of claim 15, wherein the first and the second locking arm are pivotally coupled to the first hinge member.

19. The vacuum cleaning device of claim 18, wherein the single actuator is disposed on the first hinge member.

20. The vacuum cleaning device of claim 19, wherein the single actuator includes a locking collar pivotally coupled to the first hinge member, the locking collar including at least one release button and a biasing device configured to urge the locking collar to a default locking position corresponding to a position in which the first and the second locking arm are secured to corresponding locking cavities when in either the extended position or storage configuration, respectively.

* * * * *